US011891750B2

(12) United States Patent
Rodriguez Munoz

(10) Patent No.: US 11,891,750 B2
(45) Date of Patent: Feb. 6, 2024

(54) DRYER APPLIANCE AND METHODS FOR ADDITIVE DISPENSING

(71) Applicant: Haier US Appliance Solutions, Inc., Wilmington, DE (US)

(72) Inventor: Jose Efren Rodriguez Munoz, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 62 days.

(21) Appl. No.: 17/836,398

(22) Filed: Jun. 9, 2022

(65) Prior Publication Data

US 2023/0399791 A1 Dec. 14, 2023

(51) Int. Cl.
*D06F 58/44* (2020.01)
*D06F 58/20* (2006.01)

(52) U.S. Cl.
CPC ..... *D06F 58/44* (2020.02); *D06F 58/203* (2013.01)

(58) Field of Classification Search
CPC ..... D06F 58/44; D06F 58/203
See application file for complete search history.

(56) References Cited

U.S. PATENT DOCUMENTS

| | | | |
|---|---|---|---|
| 7,066,412 | B2 | 6/2006 | Conley et al. |
| 7,096,601 | B2 * | 8/2006 | Lyu ..... D06F 29/00 34/595 |
| 8,677,246 | B2 | 3/2014 | Shin et al. |
| 9,832,821 | B2 | 11/2017 | Unagami et al. |
| 10,333,731 | B2 | 6/2019 | Ebrom et al. |
| 2005/0076533 | A1 | 4/2005 | Huston et al. |
| 2014/0345474 | A1 | 11/2014 | Rocha et al. |
| 2020/0002873 | A1 | 1/2020 | Chae et al. |
| 2021/0189631 | A1 | 6/2021 | Kessler et al. |

FOREIGN PATENT DOCUMENTS

| | | | |
|---|---|---|---|
| CN | 107357618 | A | 11/2017 |
| JP | 2002092206 | A | 3/2002 |
| JP | 2005527338 | A | 9/2005 |
| KR | 100966882 | B1 | 6/2010 |
| KR | 101040493 | B1 | 6/2011 |
| WO | WO2018067083 | A2 | 4/2018 |
| WO | WO2021120955 | A1 | 6/2021 |

* cited by examiner

*Primary Examiner* — Jessica Yuen
(74) *Attorney, Agent, or Firm* — Dority & Manning, P.A.

(57) ABSTRACT

A dryer appliance may include a cabinet, a drum, an additive dispensing assembly, and a controller. The drum may define a drying chamber for receipt of clothes for drying. The additive dispensing assembly may be positioned within the cabinet and configured to selectively provide a dryer additive to the drying chamber. The controller may be in operable communication with the additive dispensing assembly. The controller may be configured to initiate a drying operation. The drying operation may include obtaining washer operating parameters from a washing machine appliance, determining an occurrence end time of a washing operation occurrence based on obtaining washer operating parameter, initiating a dry cycle for a laundry load following obtaining the washer operating parameters, and directing a supplemental dispensing action of the dryer additive at the additive dispensing assembly based on the occurrence end time of the washing operation occurrence.

18 Claims, 6 Drawing Sheets

DRYER APPLIANCE AND METHODS FOR ADDITIVE DISPENSING

FIELD OF THE INVENTION

The present subject matter relates generally to laundry appliances, and more particularly, to dryer appliances and methods of improving dryer operation based on washing machine operations.

BACKGROUND OF THE INVENTION

Laundry appliances, such as washing machine appliances and dryer appliances, are commonly used to wash and dry, respectively, a load of clothes. Specifically, washing machine appliances generally include a wash tub for containing water or wash fluid and a wash basket rotatably mounted within the wash tub for receiving the load of clothes. These washing machines are typically equipped to operate in one or more modes or cycles, such as wash, rinse, and spin cycles. After the washing machine processes are complete, the load of clothes is moved over the to the dryer, which includes a cabinet with a drum rotatably mounted therein and a heating assembly that supplies heated air into a chamber of the drum, e.g., through a duct mounted to a back wall of the drum, to facilitate a drying process.

One of the practical issues that can arise during the use of laundry appliances stems from a user forgetting to immediately remove laundry articles (i.e., a load of clothes) from the washing machine appliance and move them to the dryer appliance (e.g., after a washing operation ends). Large stretches of time may pass between when a washing load has finished (i.e., the end of the corresponding wash cycle) and when a drying load begins (i.e., the start of the corresponding dry cycle). Damp laundry articles may remain within the washing machine appliance, or otherwise stay wet, for an extended period of time. This may, in turn, cause an undesirable smell to attach to the laundry articles (e.g., as bacteria grows on the articles).

Some users may attempt to cover or mask odors by supplying an additive to the dryer appliance. For instance, dryer sheets may be placed within the drum of a dryer appliance to affect the smell of the fabrics or clothes being treated (i.e., tumbled or dried) in a specific laundry load. However, difficulties exist with such approaches. Specifically, a user must generally remember to supply a specific object or fluid to each individual drying load. In many cases, additives are simply added once prior to starting a dry cycle, instead of when such additives may be most effective. Moreover, in many cases a user must estimate or guess how much of the specific object or fluid is appropriate for an individual load.

Accordingly, a dryer appliance capable of delivering one or more additives affecting the smell or performance of fabrics would be desirable. Additionally or alternatively, it may be useful to provide a dryer appliance or method for dispensing one or more additives at a variable amount (e.g., after such articles have remained damp for an extended period of time).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dryer appliance is provided. The dryer appliance may include a cabinet, a drum, an additive dispensing assembly, and a controller. The drum may be rotatably mounted within the cabinet. The drum may define a drying chamber for receipt of clothes for drying. The additive dispensing assembly may be positioned within the cabinet and configured to selectively provide a dryer additive to the drying chamber. The controller may be in operable communication with the additive dispensing assembly. The controller may be configured to initiate a drying operation. The drying operation may include obtaining washer operating parameters from a washing machine appliance, determining an occurrence end time of a washing operation occurrence based on obtaining washer operating parameter, initiating a dry cycle for a laundry load following obtaining the washer operating parameters, and directing a supplemental dispensing action of the dryer additive at the additive dispensing assembly based on the occurrence end time of the washing operation occurrence.

In another exemplary aspect of the present disclosure, a method of operating a dryer appliance is provided. The method may include obtaining washer operating parameters from a washing machine appliance. The method may further include determining an occurrence end time of a washing operation occurrence based on obtaining washer operating parameter. The method may still further include initiating a dry cycle for a laundry load following obtaining the washer operating parameters and directing a supplemental dispensing action of a dryer additive at the additive dispensing assembly based on the occurrence end time of the washing operation occurrence.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
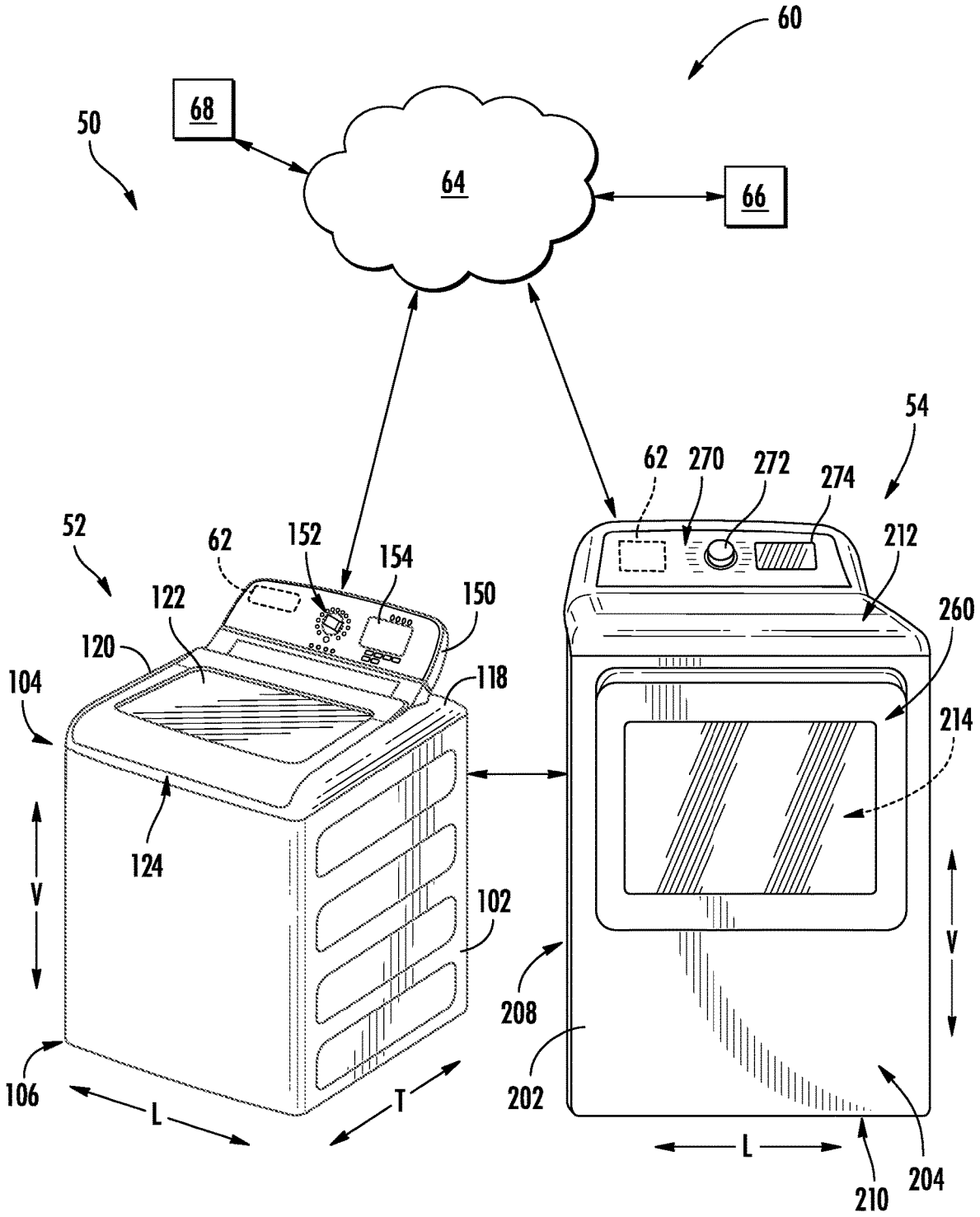
FIG. 1 provides a schematic representation of a laundry appliance system that includes a washing machine appliance, a dryer appliance, and an external communication system according to an exemplary embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes"and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally,""about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates a laundry appliance system 50 according to exemplary embodiments of the present subject matter. As shown, laundry appliance system 50 generally includes a washing machine appliance 52 and a dryer appliance 54, for washing and drying clothes, respectively. Each of washing machine appliance 52 and dryer appliance 54 will be described below according to exemplary embodiments of the present subject matter. Specifically, these figures illustrate various views of washing machine 52 and dryer appliance 54 in order to facilitate discussion regarding the use and operation of laundry system 50. However, it should be appreciated that the specific appliance configurations illustrated and described are only exemplary, and the scope of the present subject matter is not limited to the configurations set forth herein. Furthermore, it should be appreciated that like reference numerals may be used to refer to the same or similar features between washing machine 52 and dryer appliance 54.

Referring still to FIG. 1, a schematic diagram of an external communication system 60 will be described according to an exemplary embodiment of the present subject matter. In general, external communication system 60 is configured for permitting interaction, data transfer, and other communications between and among washing machine 52, dryer appliance 54, or a user of such appliances. For example, this communication may be used to provide and receive operating parameters, cycle settings, performance characteristics, user preferences, or any other suitable information for improved performance of laundry system 50.

As illustrated, each of washing machine appliance 52 and dryer appliance 54 may include a controller 62 (described in more detail below). External communication system 60 permits controllers 62 of washer appliance 52 and dryer appliance 54 to communicate with external devices either directly or through a network 64. For example, a consumer may use a consumer device 66 to communicate directly with washing machine 52 or dryer appliance 54. Alternatively, these appliances may include user interfaces for receiving such input (described below). For example, consumer devices 66 may be in direct or indirect communication with washing machine 52 and dryer appliance 54, e.g., directly through a local area network (LAN), Wi-Fi, Bluetooth, Zigbee, etc. or indirectly through network 64. In general, consumer device 66 may be any suitable device for providing or receiving communications or commands from a user. In this regard, consumer device 66 may include, for example, a personal phone, a tablet, a laptop computer, or another mobile device.

In addition, a remote server 68 may be in communication with washing machine 52, dryer appliance 54, or consumer device 66 through network 64. In this regard, for example, remote server 68 may be a cloud-based server 68, and is thus located at a distant location, such as in a separate state, country, etc. In general, communication between the remote server 68 and the client devices may be carried via a network interface using any type of wireless connection, using a variety of communication protocols (e.g. TCP/IP, HTTP, SMTP, FTP), encodings or formats (e.g. HTML, XML), or protection schemes (e.g. VPN, secure HTTP, SSL).

In general, network 64 can be any type of communication network. For example, network 64 can include one or more of a wireless network, a wired network, a personal area network, a local area network, a wide area network, the internet, a cellular network, etc. According to an exemplary embodiment, consumer device 66 may communicate with a remote server 68 over network 64, such as the internet, to provide user inputs, transfer operating parameters or performance characteristics, etc. In addition, consumer device 66 and remote server 68 may communicate with washing machine 52 and dryer appliance 54 to communicate similar information.

External communication system 60 is described herein according to an exemplary embodiment of the present subject matter. However, it should be appreciated that the exemplary functions and configurations of external communication system 60 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Figure 2:
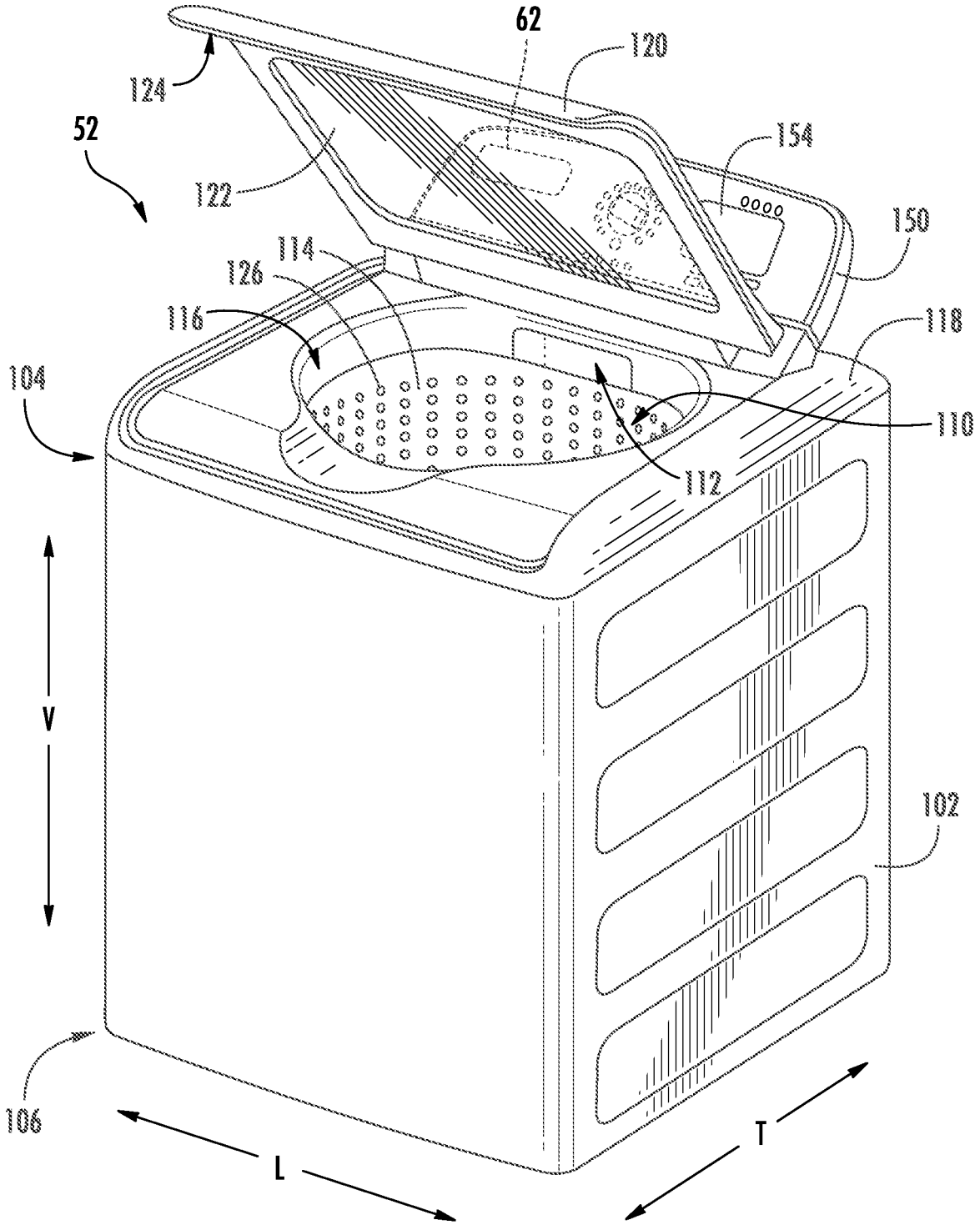
FIG. 2 provides a perspective view of the exemplary washing machine appliance of FIG. 1 with the door of the exemplary washing machine appliance shown in an open position.
Figure 3:
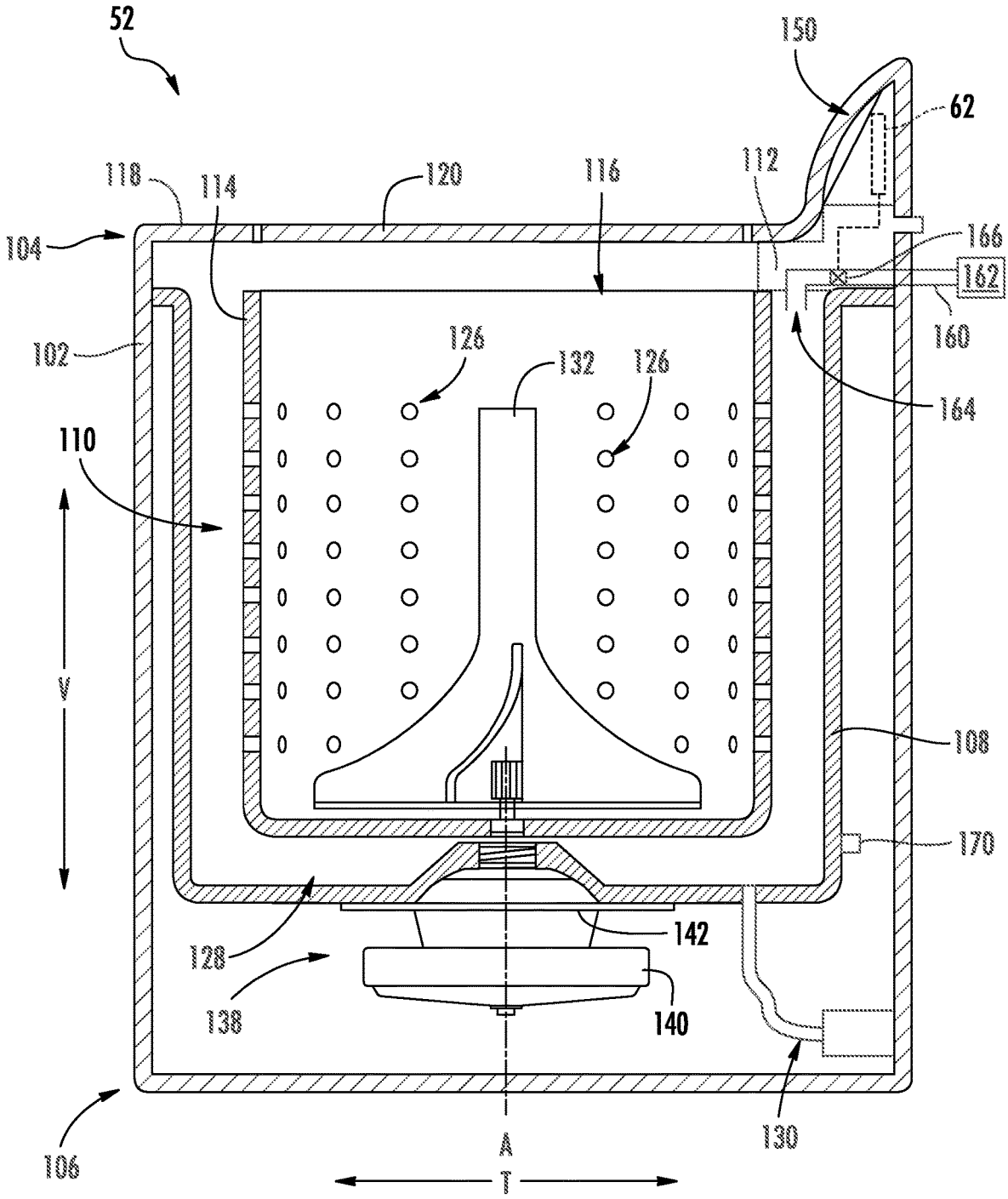
FIG. 3 provides a side cross-sectional view of the exemplary washing machine appliance of FIG. 1.

Referring now also to FIGS. 2 and 3, washing machine appliance 52 will be described according to an exemplary embodiment of the present subject matter. Specifically, these figures illustrate an exemplary embodiment of a vertical axis washing machine appliance 52. Specifically, FIGS. 1 and 2 illustrate perspective views of washing machine appliance 52 in a closed and an open position, respectively. FIG. 3 provides a side cross-sectional view of washing machine appliance 52. Washing machine appliance 52 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 52, it should be appreciated that vertical axis washing machine appliance 52 is provided by way of example only. It will be understood that aspects of the present subject matter may be used in any other suitable washing machine appliance, such as a horizontal axis washing machine appliance. Indeed, modifications and variations may be made to washing machine appliance 52, including different configurations, different appearances, or different features while remaining within the scope of the present subject matter.

Washing machine appliance 52 has a cabinet 102 that extends between a top portion 104 and a bottom portion 106 along the vertical direction V, between a first side (left) and a second side (right) along the lateral direction L, and between a front and a rear along the transverse direction T. As best shown in FIG. 3, a wash tub 108 is positioned within cabinet 102, defines a wash chamber 110, and is generally configured for retaining wash fluids during an operating cycle. Washing machine appliance 52 further includes a primary dispenser 112 (FIG. 2) for dispensing wash fluid into wash tub 108. The term "wash fluid" refers to a liquid used for washing or rinsing articles during an operating cycle and may include any combination of water, detergent, fabric softener, bleach, and other wash additives or treatments.

In addition, washing machine appliance 52 includes a wash basket 114 that is positioned within wash tub 108 and generally defines an opening 116 for receipt of articles for washing. More specifically, wash basket 114 is rotatably mounted within wash tub 108 such that it is rotatable about an axis of rotation A. According to the illustrated embodiment, the axis of rotation A is substantially parallel to the vertical direction V. In this regard, washing machine appliance 52 is generally referred to as a "vertical axis" or "top load" washing machine appliance 52. However, it should be appreciated that aspects of the present subject matter may be used within the context of a horizontal axis or front load washing machine appliance as well.

As illustrated, cabinet 102 of washing machine appliance 52 has a top panel 118. Top panel 118 defines an opening (FIG. 2) that coincides with opening 116 of wash basket 114 to permit a user access to wash basket 114. Washing machine appliance 52 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 114. Conversely, in the open position, a user can access wash basket 114. A window 122 in door 120 permits viewing of wash basket 114 when door 120 is in the closed position, e.g., during operation of washing machine appliance 52. Door 120 also includes a handle 124 that, e.g., a user may pull or lift when opening and closing door 120. Further, although door 120 is illustrated as mounted to top panel 118, door 120 may alternatively be mounted to cabinet 102 or any other suitable support.

As best shown in FIGS. 2 and 3, wash basket 114 further defines a plurality of perforations 126 to facilitate fluid communication between an interior of wash basket 114 and wash tub 108. In this regard, wash basket 114 is spaced apart from wash tub 108 to define a space for wash fluid to escape wash chamber 110. During a spin cycle, wash fluid within articles of clothing and within wash chamber 110 is urged through perforations 126 wherein it may collect in a sump 128 defined by wash tub 108. Washing machine appliance 52 further includes a pump assembly 130 (FIG. 3) that is located beneath wash tub 108 and wash basket 114 for gravity assisted flow when draining wash tub 108.

An impeller or agitation element 132 (FIG. 3), such as a vane agitator, impeller, auger, oscillatory basket mechanism, or some combination thereof is disposed in wash basket 114 to impart an oscillatory motion to articles and liquid in wash basket 114. More specifically, agitation element 132 extends into wash basket 114 and assists agitation of articles disposed within wash basket 114 during operation of washing machine appliance 52, e.g., to facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 114 are oriented to rotate about axis of rotation A (which is substantially parallel to vertical direction V).

As best illustrated in FIG. 3, washing machine appliance 52 includes a drive assembly 138 in mechanical communication with wash basket 114 to selectively rotate wash basket 114 (e.g., during an agitation or a rinse cycle of washing machine appliance 52). In addition, drive assembly 138 may also be in mechanical communication with agitation element 132. In this manner, drive assembly 138 may be configured for selectively rotating or oscillating wash basket 114 or agitation element 132 during various operating cycles of washing machine appliance 52.

More specifically, drive assembly 138 may generally include one or more of a drive motor 140 and a transmission assembly 142, e.g., such as a clutch assembly, for engaging and disengaging wash basket 114 or agitation element 132. According to the illustrated embodiment, drive motor 140 is a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Referring still to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, or other items of interest to appliance users regarding operation.

Operation of washing machine appliance 52 is controlled by a controller or processing device 62 that is operatively coupled to control panel 150 for user manipulation to select washing machine cycles and features. In response to user manipulation of control panel 150, controller 62 operates the various components of washing machine appliance 52 to execute selected machine cycles and features. According to an exemplary embodiment, controller 62 may include a memory and microprocessor, such as a general or special purpose microprocessor operable to execute programming instructions or micro-control code associated with methods described herein. Alternatively, controller 62 may be constructed without using a microprocessor, e.g., using a combination of discrete analog or digital logic circuitry (such as switches, amplifiers, integrators, comparators, flip-flops, AND gates, and the like) to perform control functionality instead of relying upon software. Control panel 150 and other components of washing machine appliance 52 may be in communication with controller 62 via one or more signal lines or shared communication busses.

During operation of washing machine appliance 52, laundry items are loaded into wash basket 114 through opening 116, and washing operation is initiated through operator manipulation of input selectors 152. Wash basket 114 is filled with water and detergent or other fluid additives via primary dispenser 112. One or more valves can be controlled by washing machine appliance 52 to provide for filling wash tub 108 and wash basket 114 to the appropriate level for the amount of articles being washed or rinsed. By way of example for a wash mode, once wash basket 114 is properly filled with fluid, the contents of wash basket 114 can be agitated (e.g., with agitation element 132 as discussed previously) for washing of laundry items in wash basket 114.

More specifically, referring again to FIG. 3, a water fill process will be described according to an exemplary embodiment. As illustrated, washing machine appliance 52 includes a water supply conduit 160 that provides fluid communication between a water supply source 162 (such as a municipal water supply) and a discharge nozzle 164 for directing a flow of water into wash chamber 110. In addition, washing machine appliance 52 includes a water fill valve or water control valve 166 which is operably coupled to water supply conduit 160 and communicatively coupled to controller 62. In this manner, controller 62 may regulate the operation of water control valve 166 to regulate the amount of water within wash tub 108. In addition, washing machine appliance 52 may include one or more pressure sensors 170 for detecting the amount of water and or clothes within wash tub 108. For example, pressure sensor 170 may be operably coupled to a side of tub 108 for detecting the weight of wash tub 108, which controller 62 may use to determine a volume of water in wash chamber 110 and a subwasher load weight.

After wash tub 108 is filled and the agitation phase of the wash cycle is completed, wash basket 114 can be drained, e.g., by drain pump assembly 130. Laundry articles can then be rinsed by again adding fluid to wash basket 114 depending on the specifics of the cleaning cycle selected by a user. The impeller or agitation element 132 may again provide agitation within wash basket 114. One or more spin cycles may also be used as part of the cleaning process. In particular, a spin cycle may be applied after the wash cycle or after the rinse cycle in order to wring wash fluid from the articles being washed. During a spin cycle, wash basket 114 is rotated at relatively high speeds to help wring fluid from the laundry articles through perforations 126. After articles disposed in wash basket 114 are cleaned or washed, the user can remove the articles from wash basket 114, e.g., by reaching into wash basket 114 through opening 116.

Figure 4:
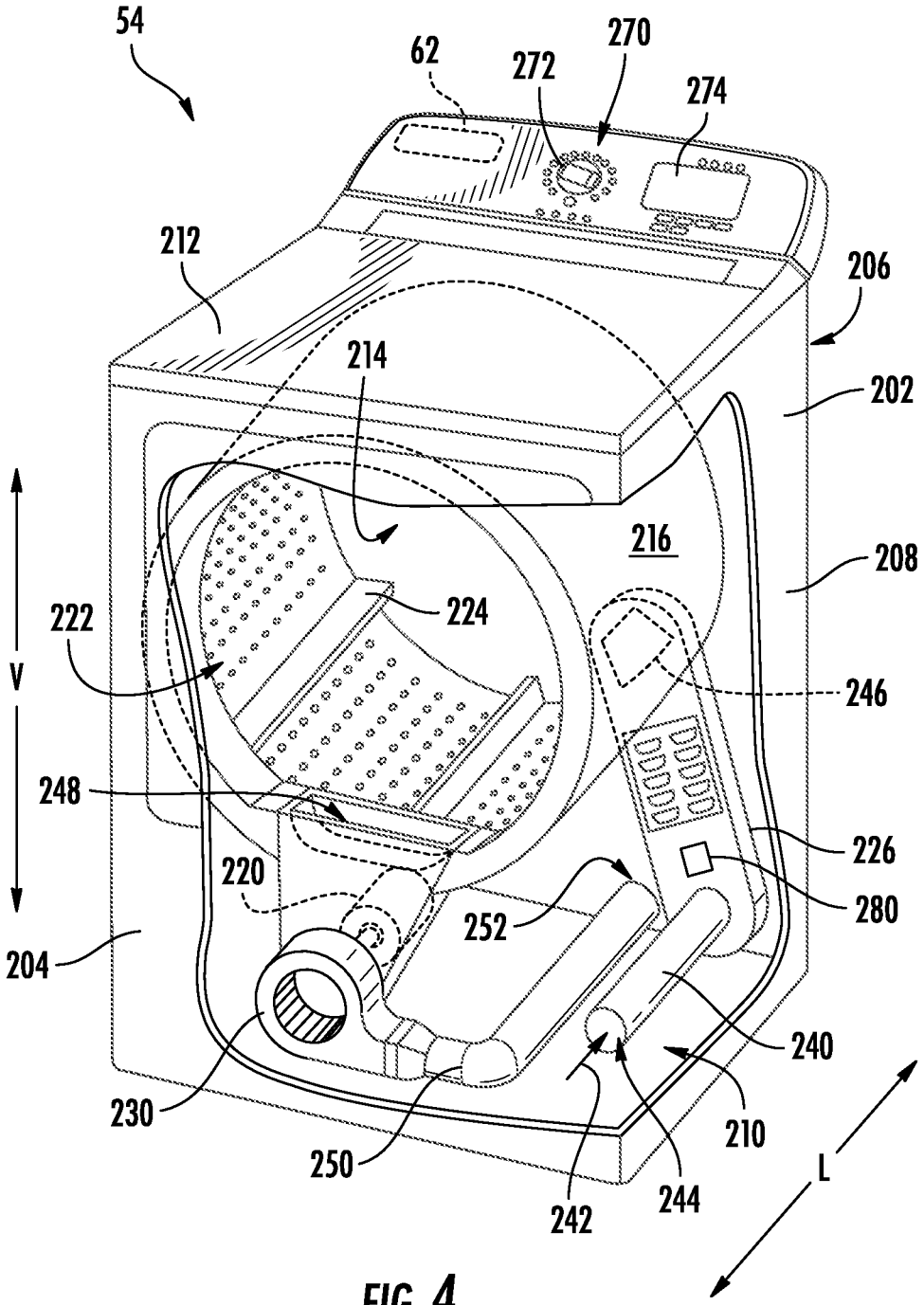
FIG. 4 provides a perspective view of the exemplary dryer appliance of FIG. 1, with portions of a cabinet of the dryer appliance removed to reveal certain components of the dryer appliance.
Figure 5:
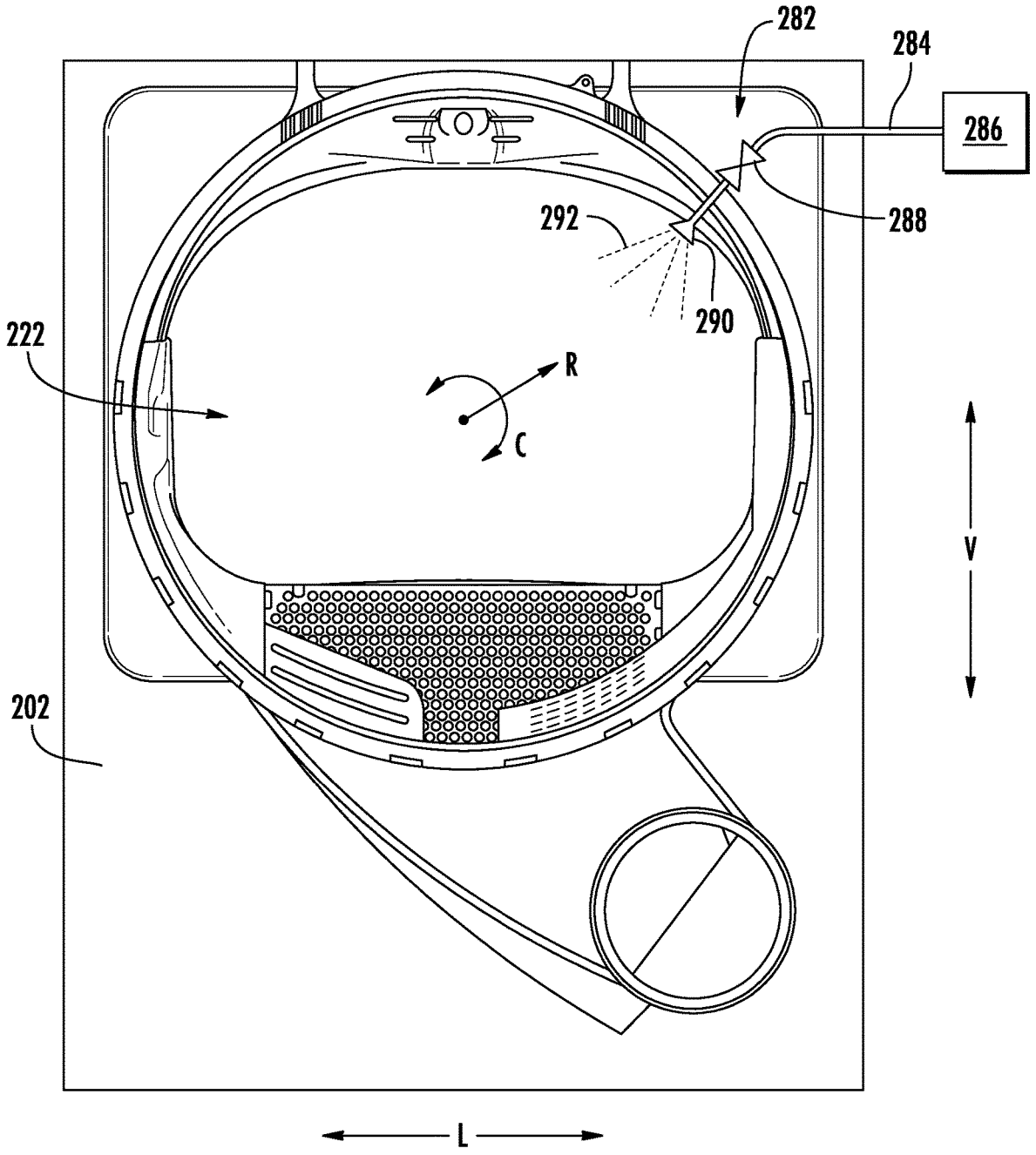
FIG. 5 provides a partial, perspective view of a drying chamber of the exemplary dryer appliance of FIG. 1.

Referring now to FIGS. 4 and 5, FIG. 4 provides a perspective view of dryer appliance 54 with a portion of a cabinet or housing 202 of dryer appliance 54 removed in order to show certain components of dryer appliance 54. FIG. 5 provides a partial, perspective view of a drying chamber 214 of dryer appliance 54. While described in the context of a specific embodiment of dryer appliance 54, using the teachings disclosed herein it will be understood that dryer appliance 54 is provided by way of example only. Other dryer appliances having different appearances and different features may also be utilized with the present subject matter as well, such as a vertical axis dryer appliance. Indeed, modifications and variations may be made to dryer appliance 54, including different configurations, different appearances, or different features while remaining within the scope of the present subject matter.

Cabinet 202 includes a front panel 204, a rear panel 206, a pair of side panels 208 spaced apart from each other by front and rear panels 204 and 206, a bottom panel 210, and a top cover 212. Within cabinet 202 is a drum or container 216 mounted for rotation about a substantially horizontal axis, e.g., that is parallel or substantially parallel to the lateral direction L. Drum 216 defines a chamber 214 for receipt of articles, e.g., clothing, linen, etc., for drying. Drum 216 extends between a front portion and a back portion, e.g., along the lateral direction L.

A motor 220 is configured for rotating drum 216 about the horizontal axis, e.g., via a pulley and a belt (not shown). Drum 216 is generally cylindrical in shape, having an outer cylindrical wall or cylinder and a front flange or wall that defines an entry 222 of drum 216, e.g., at the front portion of drum 216, for loading and unloading of articles into and out of chamber 214 of drum 216. A plurality of tumbling ribs 224 are provided within chamber 214 of drum 216 to lift articles therein and then allow such articles to tumble back to a bottom of drum 216 as drum 216 rotates. Drum 216 also includes a back or rear wall, e.g., such that drum 216 is rotatable on its rear wall as will be understood by those skilled in the art. A duct 226 is mounted to the rear wall of drum 216 and receives heated air that has been heated by a heating assembly or system 240.

Motor 220 is also in mechanical communication with an air handler 230 such that motor 220 rotates air handler 230, e.g., a centrifugal fan. Air handler 230 is configured for drawing air through chamber 214 of drum 216, e.g., in order to dry articles located therein as discussed in greater detail below. In alternative exemplary embodiments, dryer appliance 54 may include an additional motor (not shown) for rotating air handler 230 independently of drum 216.

Drum 216 is configured to receive heated air that has been heated by a heating assembly 240, e.g., in order to dry damp articles disposed within chamber 214 of drum 216. Heating assembly 240 includes a heating element (not shown), such as a gas burner or an electrical resistance heating element, for heating air. As discussed above, during operation of dryer appliance 54, motor 220 rotates drum 216 and air handler 230 such that air handler 230 draws air through chamber 214 of drum 216 when motor 220 rotates. In particular, ambient air (identified herein generally by reference numeral 242) enters heating assembly 240 via an entrance 244 due to air handler 230 urging such ambient air into entrance 244. Such ambient air is heated within heating assembly 240 and exits heating assembly 240 as heated air 242. Air handler 230 draws such heated air through duct 226 to drum 216. The heated air enters drum 216 through an outlet 246 of duct 226 positioned at the rear wall of drum 216.

Within chamber 214, the heated air can accumulate moisture, e.g., from damp articles disposed within chamber 214. In turn, air handler 230 draws humid air through a trap duct 248 which contains a screen filter (not shown) which traps lint particles. Such humid air then passes through trap duct 248 and air handler 230 before entering an exhaust conduit 250. From exhaust conduit 250, such humid air passes out of dryer appliance 54 through a vent 252 defined by cabinet 202. After the clothing articles have been dried, they are removed from the drum 216 via entry 222. A door 260 provides for closing or accessing drum 216 through entry 222.

A user interface panel 270 is positioned on a cabinet backsplash and includes a cycle selector knob 272 that is in communication with a processing device or controller (such as a controller 62). Signals generated in controller 62 operate motor 220, air hander, 230, and heating assembly 240 in response to the position of selector knobs 272. User interface panel 270 may further conclude additional indicators, a display screen, a touch screen interface 174, etc. for providing information to a user of the dryer appliance 54 and receiving suitable operational feedback. Alternatively, a touch screen type interface, knobs, sliders, buttons, speech recognition, etc., mounted to cabinet backsplash or at any other suitable location to permit a user to input control commands for dryer appliance 54 or controller 62.

Controller 62 may include memory and one or more processing devices such as microprocessors, CPUs or the like, such as general or special purpose microprocessors operable to execute programming instructions or micro-control code associated with operation of dryer appliance 54. The memory can represent random access memory such as DRAM, or read only memory such as ROM or FLASH. The processor executes programming instructions stored in the memory. The memory may be a separate component from the processor or may be included onboard within the processor. Alternatively, controller 62 may be constructed without using a microprocessor, e.g., using a combination of discrete analog or digital logic circuitry (such as switches, amplifiers, integrators, comparators, flip-flops, AND gates, and the like) to perform control functionality instead of relying upon software.

In general, controller 62 is in operative communication with various components of dryer appliance 54. In particular, controller 62 is in operative communication with motor 220 and heating assembly 240. Thus, upon receiving an activation signal from cycle selector knob 272, controller 62 can activate motor 220 to rotate drum 216 and air handler 230. Controller 62 can also activate heating assembly 240 in order to generate heated air for drum 216, e.g., in the manner described above.

Controller 62 is also in communication with a thermal or temperature sensor 280, e.g., a thermocouple or thermistor. Temperature sensor 280 is configured for measuring a temperature of heated air within duct 226. Temperature sensor 280 can be positioned at any suitable location within dryer appliance 54. For example, temperature sensor 280 may be positioned within or on duct 226. Controller 62 can receive a signal from temperature sensor 280 that corresponds to a temperature measurement of heated air within duct 226, e.g., a temperature measurement of heated air exiting duct 226 at outlet 246.

Referring especially to FIG. 5, dryer appliance 54 may further include an additive supply 282 for selectively providing a dryer additive into chamber 214 (e.g., to treat articles within a dryer load). Such dryer additives may include an odor neutralizer (e.g., fluid configured to bind to odor molecules, such as an acidic liquid, antibacterial, or liquid containing protease or amylase enzymes) or a perfume material or liquid to provide a desirable smell or scent to a load. Moreover, it is noted that any other suitable laundry additive may be included.

In some embodiments, as illustrated, additive supply 282 includes a supply conduit 284 fluidly coupled to an additive reservoir or source 286 (e.g., within cabinet 202 or outside thereof). A supply valve 288 may be operably coupled to supply conduit 284 for regulating the flow or movement of additive therethrough. In optional embodiments, additive supply 282 includes a nozzle 290, such as a misting nozzle, that is fluid coupled to the supply conduit 284 and is positioned for discharging the flow of additive into chamber 214. Specifically, according to an exemplary embodiment, nozzle 290 is configured for receiving the flow of a liquid additive and generating a fine mist (indicated by reference numeral 292 in FIG. 5) that is dispersed throughout chamber 214. It should be appreciated that according to alternative embodiments, dryer appliance 54 may include any other suitable number, type, position, and configuration of water supply nozzles, conduits, motors, paddles, dispensers, or subsystems.

Now that the construction of system 50, washing machine 52, dryer appliance 54, and external communication system 60 have been presented according to exemplary embodiments, an exemplary method 600 of operating a system of laundry appliances will be described. Although the discussion below refers to the exemplary method 600 of operating system 50 to improve the operation of dryer appliance 54, one skilled in the art will appreciate that the exemplary method 600 is applicable to the monitoring and control of any suitable system of laundry appliances. In exemplary embodiments, the various method steps as disclosed herein may be performed by controllers 62, remote server 68, or a separate, dedicated controller.

Figure 6:
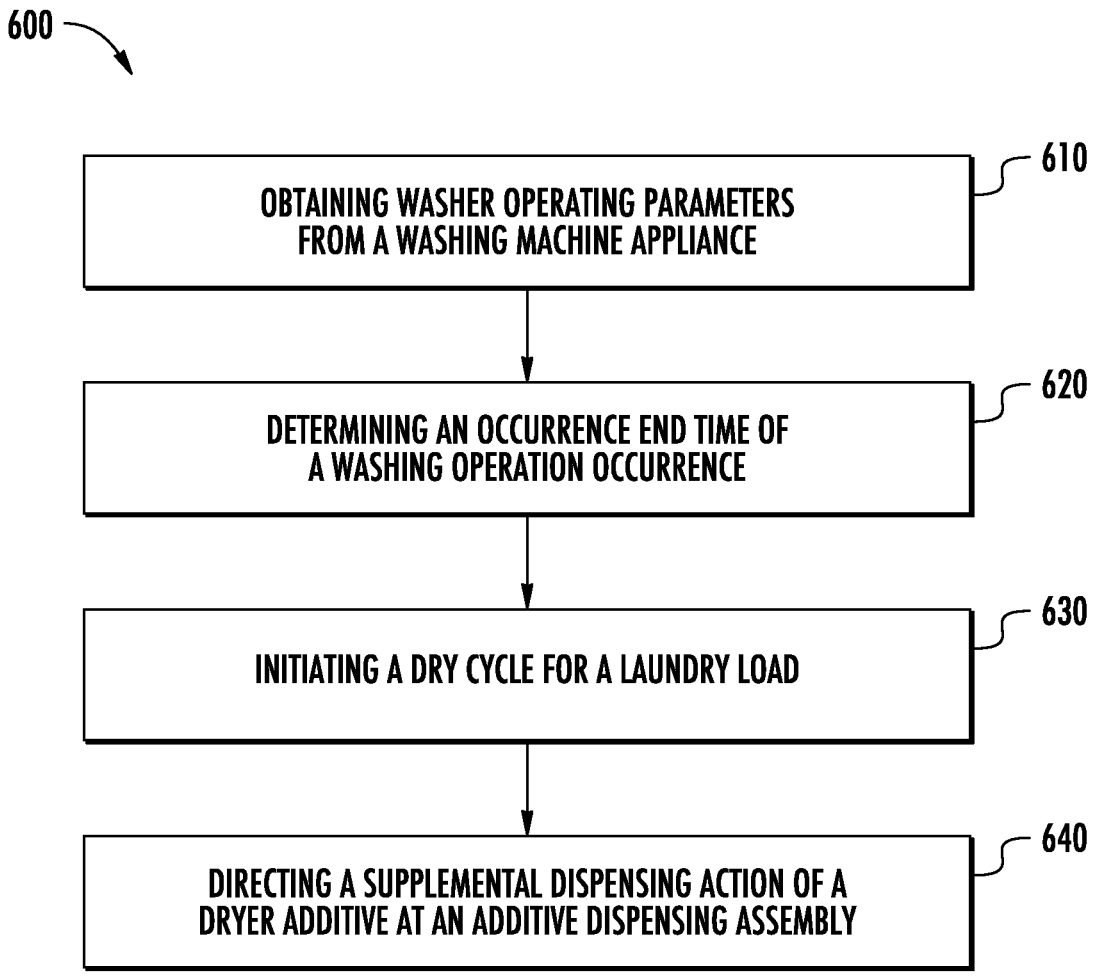
FIG. 6 provides a flow chart illustrating a method of operating a dryer appliance according to exemplary embodiments of the present disclosure.

Referring generally to FIG. 6, a method of operating a dryer appliance in a laundry system is provided. FIG. 6 depicts steps performed in a particular order for purpose of illustration and discussion. Those of ordinary skill in the art, using the disclosures provided herein, will understand that the steps of any of the methods disclosed herein can be modified, adapted, rearranged, omitted, or expanded in various ways without deviating from the scope of the present disclosure.

Advantageously, methods in accordance with the present disclosure may automatically (e.g., without direct user instruction or intervention) dispense one or more additives affecting the smell or performance of fabrics. Additionally or alternatively, methods in accordance with the present disclosure may facilitate dispensing one or more additives at a variable amount (e.g., after such articles have remained damp for an extended period of time), thereby improving dryer performance or customer satisfaction.

At 610, the method 600 includes obtaining washer operating parameters from a washing machine appliance. As used herein, the term "washer operating parameters" and the like is generally intended to refer to any cycle selection, operating parameter, cycle end time, load characteristic, performance characteristic, or other qualitative or quantitative measure or data related to the operation of washing machine appliance or the clothes washed therein (e.g., the laundry load).

For example, according to an exemplary embodiment, the washer operating parameters that are obtained from washing machine appliance may include at least one of a load type, a load weight (dry or wet load weight), a remaining moisture content (RMC), or any other operating parameter or characteristic that is implemented or monitored by washing machine appliance 100. According to still other exemplary embodiments, the washer operating parameters comprise a washer cycle type or any other suitable input that may be selected by the user of the appliance or determined by controller based on load sensing processes.

It should be appreciated that the washer operating parameters that are received from washing machine appliance may be provided to dryer appliance in any suitable manner. In some embodiments, the washing machine appliance is linked to the dryer appliance. In turn, the washer operating parameters may be obtained from the washing machine appliance. Optionally, the parameters may be received from (or through) a remote server or over network. In this regard, washing machine appliance may transmit these washer operating parameters to the network or remote server when measured or selected, and dryer appliance may periodically pull or download these parameters from the network. In additional or alternative embodiments, dryer appliance may be in direct wireless communication with washing machine appliance, e.g., via a Wi-Fi or Bluetooth connection. According to such an embodiment, the washer operating parameters are received directly from washing machine appliance. According to still other embodiments, washer operating parameters may be transferred in any other suitable manner, e.g., via user input, a wired connection, etc.

At 620, the method 600 includes determining an occurrence end time of a washing operation occurrence. In certain embodiments, the washer operating parameters include a timestamp corresponding to the occurrence end time as tracked by the washing machine appliance, and which can be interpreted by the dryer appliance. In additional or alternative embodiments, the dryer appliance (e.g., controller thereof) can detect a receipt time (i.e., the time at which the washer operating parameters are received at the dryer appliance) in response to 610. The transmission of washer operating parameters may occur in response to (e.g., prompted by) the end of a washing operation (i.e., the end of a discrete occurrence/execution of a washing operation or wash cycle) at the washing machine appliance. Thus, the washing machine appliance (e.g., the controller thereof) may be configured to transmit the washer operating parameters in response to a determined end point of a washing operation occurrence. Moreover, the receipt time for the washing operating parameters may notably be used as a proxy for the exact end time of the washing operation occurrence.

At 630, the method 600 includes initiating a dry cycle for a laundry load following obtaining the washer operating parameters. Generally, such dry cycles include motivating an airflow from the drying chamber and the air passage. For instance, 630 may include activating the blower air handler. In turn, the air handler may force air through a heating assembly, including an inlet conduit defining an air entrance passage, and into the drying chamber defined by an appliance drum. From the drying chamber, air handler may further force air through an exhaust conduit defining an air exhaust passage. Simultaneous to or separate from the motivated airflow, the heating assembly may be activated to heat the airflow or drying chamber, generally (e.g., as would be understood).

Prior to or following motivating an airflow, 630 may include determining a load size (e.g., of a load of clothes) in a chamber of the dryer appliance. For example, the controller may determine load size based on the obtained washer operating parameters. According to exemplary embodiments, the load size may be characterized as a large load, a small load, or any other suitable size therebetween. It should be appreciated that any suitable method of determinations of load size may be used while remaining within the scope of the present disclosure, such as a determination based on load mass, airflow velocity through the appliance, temperature changes across the appliance, user input, etc.

After the determined load size is determined, some embodiments include directing an initial dispensing action of a dryer additive (e.g., from an additive assembly, as described above). For instance, the initial dispensing action may be based on the determined load size. Thus, the additive assembly may be directed to release or motivate an initial volume or amount of dryer additive to the drying chamber. Optionally, larger loads may receive larger volumes or amount of dryer additive (e.g., in comparison to medium or small loads). The difference may be proportional, or alternatively, based on two or more fixed tiers (e.g., volumes or amounts) of dryer additive to be dispensed based on the determined load size. Additionally or alternatively, the initial dispensing action may occur prior to activating the heating assembly or within a set initial time period (e.g., less than two minutes) of the dry cycle.

At 640, the method 600 includes directing a supplemental dispensing action of the dryer additive at the additive dispensing assembly (e.g., based on the occurrence end time of the washing operation occurrence). Specifically, the additive assembly may be instructed (e.g., by the controller of the dryer appliance) to dispense or release a supplemental volume or amount of dryer additive to the drying chamber.

In some embodiments, 640 includes determining a specific resting period for articles (i.e., the clothes or laundry load) from the washing machine appliance following the determined occurrence end time. Such a resting period may be based on, for instance, the occurrence end time at 620. The resting period may further be based on the start of the dry cycle at 630. For instance, determining the specific resting period may include detecting a dry cycle time in response to 630. Thus, the start time of the dry cycle may be determined. In turn, determining the resting period may further include calculating the difference between the dry cycle time and the occurrence end time for the washing operation occurrence. Notably, the time in which the articles or laundry load remained static and wet may be determined.

The amount or volume of additive dispensed at 640 may be variable. In some embodiments, based on the specific resting period, an additive volume of the dryer additive may be determined. For instance, a formula, model, or lookup chart may be provided to correlate a specific resting period or range of time to a corresponding additive volume value. In certain embodiments, determining the additive volume includes selecting the additive volume from a plurality of predetermined volumes. For instance, each predetermined volume of the plurality of predetermined volumes may correspond to a unique resting period (e.g., range of resting periods or times) prior to removal of articles within the washing machine appliance (i.e., prior to the removal of the laundry load from the washing machine appliance).

As an example, a first predetermined volume of dryer additive may be provided for a first resting period (e.g., less than two hours). Thus, if the determined specific resting period falls within the first resting period, the first predetermined volume may be selected. As an additional or alternative example, a second predetermined volume (e.g., greater than the first predetermined volume) of dryer additive may be provided for a second resting period (e.g., a resting period greater than or equal to two hours and less than five hours). Thus, if the determined specific resting period falls within the second resting period, the second predetermined volume may be selected. As another additional or alternative example, a third predetermined volume (e.g., greater than the first or second predetermined volume) of dryer additive may be provided for a third resting period (e.g., a resting period greater than or equal to five hours and less than ten hours). Thus, if the determined specific resting period falls within the third resting period, the third predetermined volume may be selected. As yet another additional or alternative example, a fourth predetermined volume (e.g., greater than the first, second, or third predetermined volume) of dryer additive may be provided for a fourth resting period (e.g., a resting period greater than ten hours). Thus, if the determined specific resting period falls within the fourth resting period, the fourth predetermined volume may be selected.

Once the determined additive volume is obtained (e.g., in response to the same), 640 may provide or include dispensing the determined additive volume from the additive dispensing assembly to the drying chamber.

In optional embodiments, the method 600 includes determining completion of the dry cycle initiated at 630. In turn, 640 may follow 630 and be in response to determining completion of the dry cycle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:

a cabinet;

a drum rotatably mounted within the cabinet, the drum defining a drying chamber for receipt of clothes for drying;

an additive dispensing assembly positioned within the cabinet and configured to selectively provide a dryer additive to the drying chamber; and a controller in operable communication with the additive dispensing assembly, the controller being configured to initiate a drying operation comprising obtaining washer operating parameters from a washing machine appliance, determining an occurrence end time of a washing operation occurrence based on obtaining washer operating parameter, initiating a dry cycle for a laundry load following obtaining the washer operating parameters, and directing a supplemental dispensing action of the dryer additive at the additive dispensing assembly based on the occurrence end time of the washing operation occurrence.

2. The dryer appliance of claim 1, wherein the washing machine appliance is linked to the dryer appliance.

3. The dryer appliance of claim 1, wherein determining the occurrence end time comprises detecting a receipt time in response to obtaining washer operating parameters.

4. The dryer appliance of claim 1, wherein directing the supplemental dispensing action comprises determining a specific resting period for articles from the washing machine appliance following the determined occurrence end time, determining an additive volume of the dryer additive based on the specific resting period, and dispensing the determined additive volume from the additive dispensing assembly to the drying chamber.

5. The dryer appliance of claim 4, wherein determining the specific resting period comprises detecting a dry cycle time in response to initiating the dry cycle, and calculating a difference between the dry cycle time and the occurrence end time.

6. The dryer appliance of claim 4, wherein determining the additive volume comprises selecting the additive volume from a plurality of predetermined volumes.

7. The dryer appliance of claim 6, wherein each predetermined volume of the plurality of predetermined volumes corresponds to a unique resting period prior to removal of articles within the washing machine appliance.

8. The dryer appliance of claim 1, wherein the drying operation further comprises determining completion of the dry cycle, wherein directing the supplemental dispensing action follows determining completion of the dry cycle.

9. The dryer appliance of claim 1, wherein the dryer additive comprises a perfume or odor neutralizer.

10. A method of operating a dryer appliance comprising a cabinet, a drum defining a drying chamber, and an additive dispensing assembly, the method comprising:

obtaining washer operating parameters from a washing machine appliance;

determining an occurrence end time of a washing operation occurrence based on obtaining washer operating parameter;

initiating a dry cycle for a laundry load following obtaining the washer operating parameters; and directing a supplemental dispensing action of a dryer additive at the additive dispensing assembly based on the occurrence end time of the washing operation occurrence.

11. The method of claim 10, wherein the washing machine appliance is linked to the dryer appliance.

12. The method of claim 10, wherein determining the occurrence end time comprises detecting a receipt time in response to obtaining washer operating parameters.

13. The method of claim 10, wherein directing the supplemental dispensing action comprises determining a specific resting period for articles from the washing machine appliance following the determined occurrence end time, determining an additive volume of the dryer additive based on the specific resting period, and dispensing the determined additive volume from the additive dispensing assembly to the drying chamber.

14. The method of claim 13, wherein determining the specific resting period comprises detecting a dry cycle time in response to initiating the dry cycle, and calculating a difference between the dry cycle time and the occurrence end time.

15. The method of claim 13, wherein determining the additive volume comprises selecting the additive volume from a plurality of predetermined volumes.

16. The method of claim 15, wherein each predetermined volume of the plurality of predetermined volumes corresponds to a unique resting period prior to removal of articles within the washing machine appliance.

17. The method of claim 10, further comprising:

determining completion of the dry cycle, wherein directing the supplemental dispensing action follows determining completion of the dry cycle.

18. The method of claim 10, wherein the dryer additive comprises a perfume or odor neutralizer.

* * * * *